US005354051A

United States Patent [19]

Fehrenbach et al.

[11] Patent Number: 5,354,051

[45] Date of Patent: Oct. 11, 1994

[54] BALL RETURN PRACTICE DEVICE

[76] Inventors: Donald E. Fehrenbach, 4200 M Rd., Escanaba, Mich. 49829; Allan J. Waeghe, 7710 Summit 19.55 Dr., Gladstone, Mich. 49837

[21] Appl. No.: 57,493

[22] Filed: May 6, 1993

[51] Int. Cl.[5] ..... A63B 69/00

[52] U.S. Cl. ..... 273/29 A; 273/26 R; 273/30

[58] Field of Search ..... 273/30, 29 A, 26 A

[56] References Cited

U.S. PATENT DOCUMENTS

| | | | |
|---|---|---|---|
| 1,510,402 | 9/1924 | Hopwood . | |
| 2,066,159 | 12/1936 | Post . | |
| 2,104,375 | 6/1936 | Perry . | |
| 2,247,657 | 7/1941 | Girden | 273/30 |
| 3,001,790 | 9/1961 | Pratt | 273/26 A |
| 3,088,735 | 5/1963 | Clark . | |
| 3,563,544 | 2/1971 | Hedrick | 273/29 A |
| 3,692,307 | 9/1972 | Henry . | |
| 4,026,551 | 5/1977 | Larson | 273/30 |
| 4,134,585 | 1/1979 | Semon . | |
| 4,824,108 | 4/1989 | McLean . | |
| 4,861,027 | 8/1989 | Thaxton . | |
| 4,943,056 | 7/1990 | Bowers . | |
| 5,004,235 | 4/1991 | Suga | 273/29 A |

FOREIGN PATENT DOCUMENTS

| | | | |
|---|---|---|---|
| 2161706 | 3/1970 | Fed. Rep. of Germany | 273/30 |
| 2717364 | 10/1978 | Fed. Rep. of Germany | 273/30 |
| 2916262 | 10/1980 | Fed. Rep. of Germany | 273/29 A |
| 1297753 | 5/1962 | France | 273/30 |
| 2098829 | 10/1972 | France | 273/29 A |
| 8400497 | 2/1984 | World Int. Prop. O. | 273/29 A |

*Primary Examiner*—Theatrice Brown

*Attorney, Agent, or Firm*—Richard C. Litman

[57] ABSTRACT

A rebound board for returning projected balls toward a person practicing a ball sport. The rebound board has a textured surface subdivided into squares, each square including a shallow pyramid including an array of four triangular walls. The pyramids project from a vertical plane, and each pyramid side inclines in a different direction so as to return a ball upwardly, downwardly, to the right, or to the left. Preferably, the rebound board is two faced, each face including pyramids of different heights. Two preferred ranges of inclination of sides, one range for each face, are 2 to 6 degrees from vertical, and 5 to 9 degrees from vertical. The invention may be attached to an environmental surface. Alternatively, a supporting frame is provided to enable the device to be erected and used on a playing court.

4 Claims, 4 Drawing Sheets

BALL RETURN PRACTICE DEVICE

BACKGROUND OF THE INVENTION

1. Field of the Invention

The present invention relates to a practice aid used in a ball game, the aid comprising a surface which returns a hit ball in the direction of origin. Usable with diverse games such as tennis, racquetball, baseball, handball, and similar games, the device enables a solitary player to hit a ball and have the ball rebound back to the player, as it would be by a human adversary.

2. Description of the Prior Art

Ball game practice devices providing a ball rebound surface are well known, as exemplified by U.S. Pat. No. 1,510,402, issued to William Hopwood on Sep. 30, 1924. Hopwood discloses a practice device having a flat rebound surface intended for the game of lawn tennis.

U.S. Pat. No. 2,066,159, issued to Charles E. Post on Dec. 29, 1936, discloses a practice rebound device having two rebound surfaces of different characteristics disposed upon a vertical wall member. One surface is curved and flat, and the other is textured. The wall member is reversible so as to present one of the two rebound surfaces to the person using the device.

U.S. Pat. No. 3,088,735, issued to Theodore W. Clark on May 7, 1963, discloses a rebound board which is mountable on a table for playing table tennis. Clark configures the board to return a ball to a predetermined area corresponding to a playing field or court.

U.S. Pat. No. 3,692,307, issued to Francis B. Henry on Sep. 29, 1972, discloses a practice backboard which is augmented by visual simulation of human adversaries.

U.S. Pat. No. 4,134,585, issued to Alex Semon on Jan. 16, 1979, discloses a rebound board for a table tennis table which board is curved and bears projections which alter trajectory of a ball hit thereinto. U.S. Pat. No. 4,824,108, issued to David McLean on Apr. 25, 1989, discloses a substantially spherical rebound board for a ball game.

U.S. Pat. No. 4,861,027, issued to George K. Thaxton on Aug. 29, 1989, discloses a tennis practice apparatus having a rebound surface which controls rebound by damping.

U.S. Pat. No. 4,943,056, issued to Kevin R. Bowers on Jul. 24, 1990, discloses a table tennis practice apparatus having two rebound surfaces enabling two players to play solo simultaneously. The surfaces are independently adjustable to vary rebound angle.

None of the above inventions and patents, taken either singly or in combination, is seen to describe the instant invention as claimed.

SUMMARY OF THE INVENTION

The present invention provides a practice device for realistic practice sessions, particularly applicable to tennis, racquet ball, handball, and baseball. The practice device includes two embodiments, one being self-standing on a roller base, and the other for attachment to a solid environmental surface, such as a building wall, a garage door, or a fence. In both embodiments, a ball is propelled toward the practice device, strikes the device, and rebounds toward a person practicing the appropriate sport.

A planar vertical rebound member has a rebound surface on each of two faces, either of which rebound surface may be selected to return projected balls. Each rebound surface has slightly differing rebound characteristics.

In the preferred embodiment, the rebound member is pivotally mounted on a supporting frame. The frame has legs and rollers, enabling the practice device to be positioned on a playing court. This assures maximal verisimilitude in solo practice situations. The user pivots the rebound member to expose a desired rebound surface for practice.

The rebound surface is characterized by plural square panels each being provided with an array of inclined facets. There are four, three sided facets on each panel, arranged in pyramid style, projecting from the vertical plane so as to meet at a central point of each panel.

In use, a projected ball strikes one of the four facets. Each facet will return the ball in a different direction: upwardly, downwardly, to the right, and to the left. The panels are sufficiently small so that it is difficult for even a skilled player to predict which facet will be struck by the incoming ball. Therefore, trajectory of the return is unpredictable, but also simulates returned balls of typical situations encountered in real games.

While the situation described above is obviously simulative of tennis, racquet ball, and handball, the same principle is employed to train baseball players in fielding balls batted to the infield and outfield. Randomness of the return forces a player to learn to approach and intercept a batted ball.

Preferably, the two faces differ in the height of the pyramid. In embodiments disclosed hereinafter, two heights are selected for base line and service line practice for tennis players.

The rebound member will be cast or die formed from a suitable material, in a preferred embodiment. Special angles, shapes and curves need not be painstakingly reproduced in a die or mold, while the resultant textured surface readily produces the desired rebound characteristics. Therefore, uncomplicated geometrical configuration of the facets enables inexpensive fabrication.

Accordingly, it is a principal object of the invention to provide a practice device having a rebound surface which returns an incoming ball at an angle approximating verisimilitude.

It is another object of the invention to provide a practice device which is set up selectively on an environmental surface and on a playing court.

It is a further object of the invention to provide a practice device having two independently selectable sets of rebound characteristics.

Still another object of the invention is to provide a practice device having rebound surfaces which are configured in uncomplicated geometric shapes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
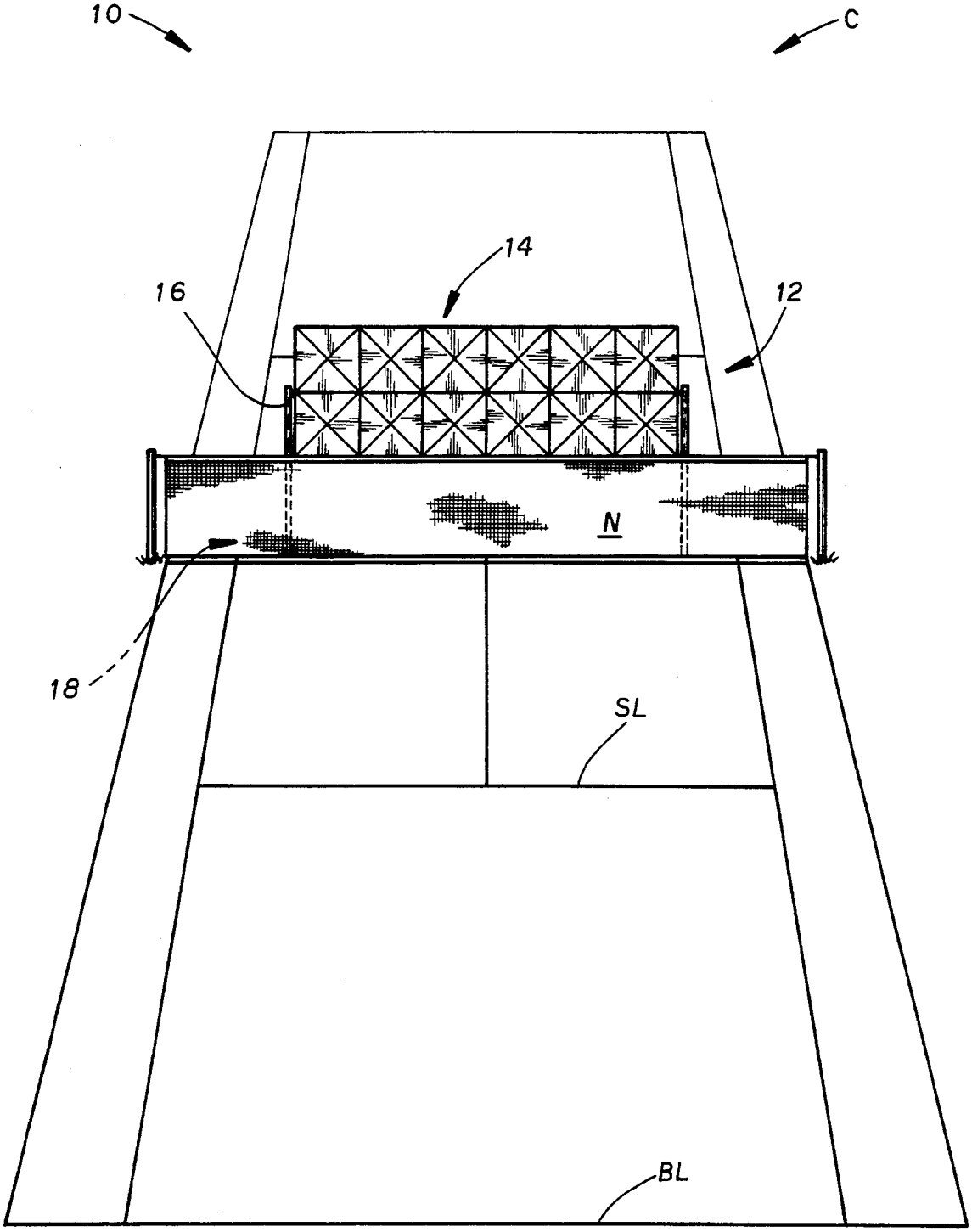
FIG. 1 is a perspective view of the invention placed on a ball playing court.

The practice device 10 of the present invention, seen in FIG. 1 to be erected behind a net N of a tennis court C, comprises a supporting frame 12 and a rebound member 14. Frame 12 includes two vertical posts 16, each having a foot 18. Better seen in FIG. 2, foot 18 has rollers 20 and roller locks 22. The practice device 10 is thus wheeled to a preferred location and immobilized there by locking rollers 20 with roller locks 22. Roller lock 22 acts in well know fashion by urging a member (not shown) against roller 20, as by a camming arrangement or by spring bias (neither shown).

Figure 2:
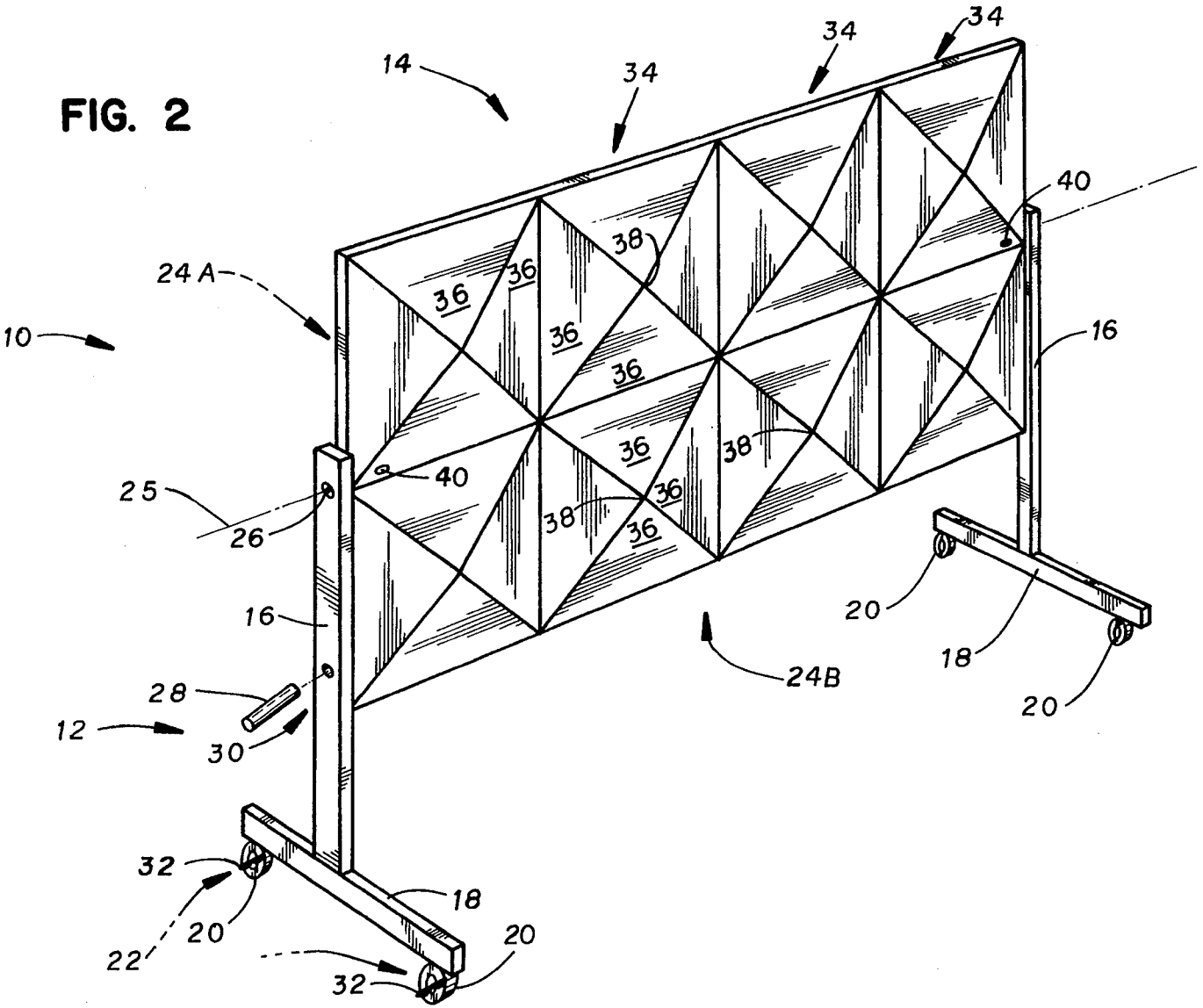
FIG. 2 is a perspective view of the invention including a supporting frame.
Figure 3:
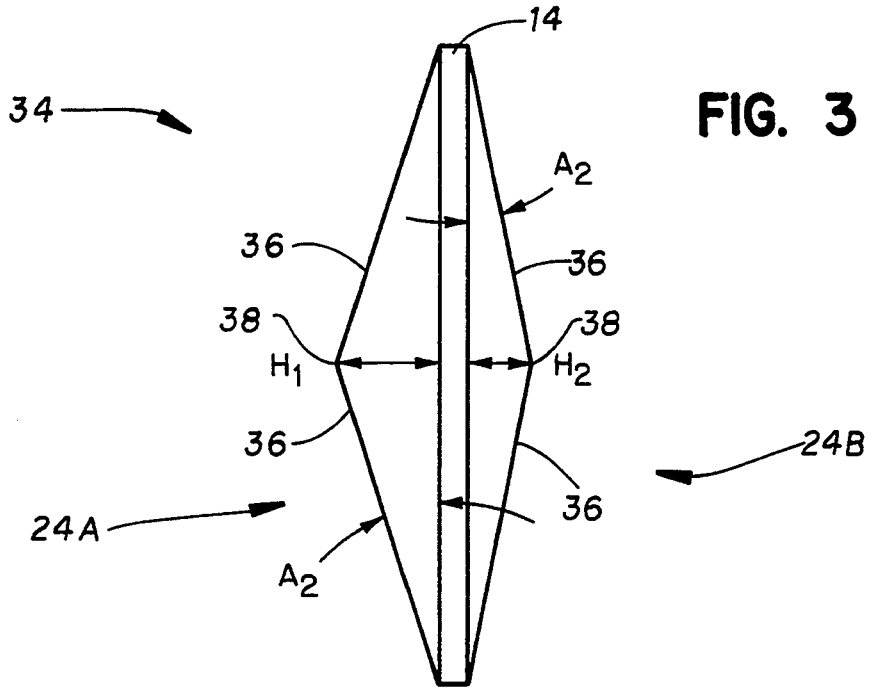
FIG. 3 is a side diagrammatic detail view of the invention.

Best seen in FIG. 3, rebound member 14 has two rebound surfaces 24A and 24B, each having different rebound characteristics. Turning again to FIG. 2, supporting frame is seen to have pivot pins 26 enabling rebound member 14 to be pivoted along an axis 25, so that either rebound surface 24A or 24B is selected without reversing the entire practice device 10. At least one securing pin 28 is inserted into aligned holes 30 located in vertical post 16 and rebound member 14, so that rebound member 14 is retained in a vertical orientation. Also seen in FIG. 2 are rollers 20 mounted to feet 18. Handles 32 operate roller locks 22.

Configuration and rebound characteristics of rebound surfaces 24A,24B will now be discussed. Again referring to FIG. 3, rebound member 14 is characterized by plural square panels 34 each defining an array of inclined facets 36. Facets 36 are inclined from a vertical plane defined by rebound member 14 within a preferred range, measured by degrees of an angle $A_1$ or $A_2$. It is preferred that square panels 34 be two feet square (approximately 60 cm square). Height $H_1$ and $H_2$ are, preferably about 0.75 inches (approximately 2 cm) and 1.5 inches (approximately 4 cm).

Resultant inclination of facets 3G from a vertical direction is, therefore, 3.57° for angle $A_1$ and 7.12° for angle $A_2$. These values are most advantageous for tennis practice from, respectively, base line BL and service line SL (see FIG. 1). Although these angles are preferred, angles falling within the ranges of two to six degrees for angle $A_1$, and five to nine degrees for angle $A_2$, wherein angle $A_2$ exceeds angle $A_1$, will result in desirable ball return trajectories.

Figure 4:
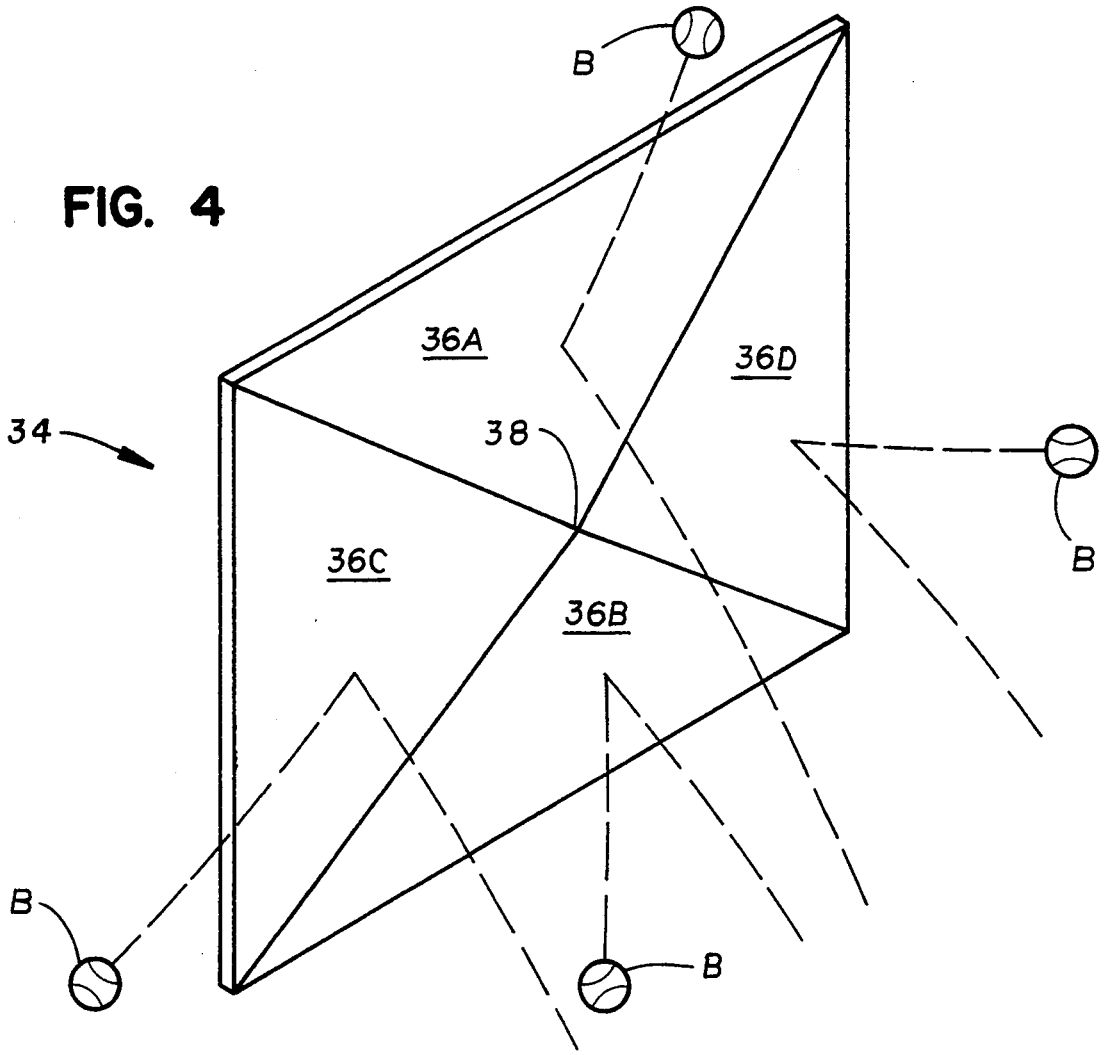
FIG. 4 is a perspective detail view of part of the invention showing rebound trajectories.

Turning now to FIG. 4, there are four, three sided facets 36A,36B,36C,36D on each panel 34, arranged in pyramid style, projecting from the vertical plane so as to meet at a central point 38. Each of the four facets 36A,36B,36C, or 36D on each panel 34 is inclined to return an incoming ball B in a different direction. It will be seen that a ball B striking top center facet 36A will rebound upwardly; a ball B striking bottom center facet 36B will rebound downwardly; and balls B striking left and right facets 36C,36D (respectively) will rebound to the left and to the right, respectively, ball trajectory being indicated by broken lines.

Figure 5:
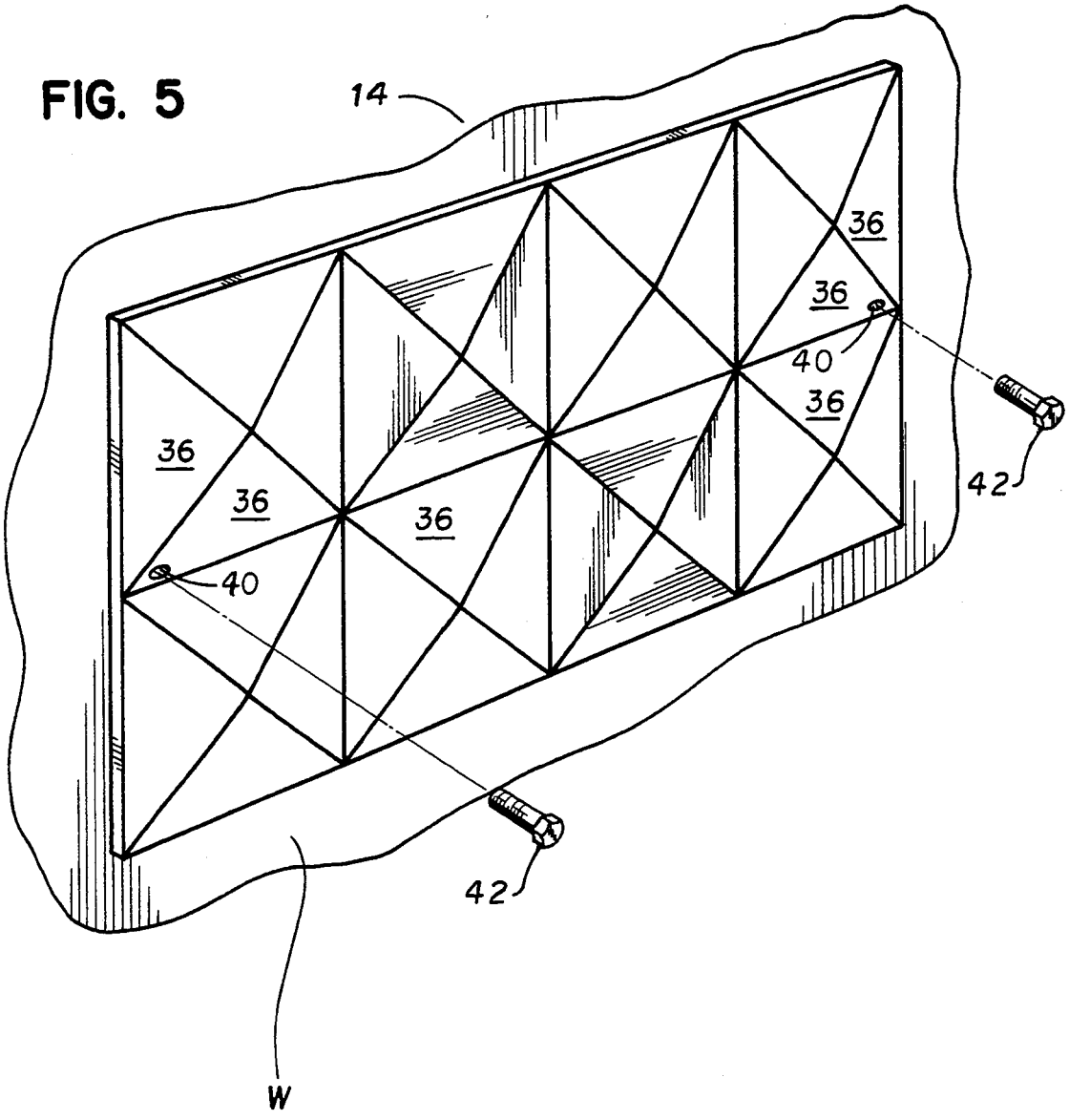
FIG. 5 is a perspective, partially exploded view of an alternative embodiment of the invention.

FIG. 5 shows an alternative embodiment of the invention wherein rebound member 14 is mounted on a vertical environmental surface, such as a building wall W. This embodiment is used where an actual practice court is not available, and is readily mounted and removed. Rebound member 14 includes a plurality of fastener holes 40 preferably located away from prominent and accessible portions of facets 36. In this embodiment, a fastener 42, such as a screw, bolt, or hook, is inserted through hole 40, engages the associated environmental surface W, and thus secures rebound member 14 thereto. Bolts, screws, and similar fasteners 42 are employed for semipermanent attachment, and a hook (not shown) is employed to secure rebound member 14 to a chain link fence (not shown) or the like.

Given the dimensions discussed above, an individual facet 36 is sufficiently small and near a neighboring facet 36 that, in a realistic practice session, it is difficult to determine which facet 36 will be struck by an incoming ball B, and hence it is difficult to anticipate the return trajectory. In light of the fact that the return trajectories are typical of actual play, the combination of typical return trajectory and almost random selection of return direction renders the situation highly realistic, and of maximal benefit to a person attempting to recreate actual tennis volleying characteristics.

It is to be understood that the present invention is not limited to the embodiments described above, but encompasses any and all embodiments within the scope of the following claims.

I claim:

1. A ball return practice device having a pair of substantially vertical back to back ball rebounding surfaces characterized by a plurality of rectangular panels, each said panel including means defining an array of inclined facets arranged in pyramid style and projecting from a vertical plane, whereby said facets meet at a central point of each said panel, said rebounding surfaces each facing in opposite directions, one of said ball rebounding surfaces having inclined facets inclined from a vertical surface in a first range between two and six degrees, and the other of said two rebounding surfaces having inclined facets inclined from a vertical surface in a second range between five and nine degrees.

2. A ball return practice device according to claim 1, wherein the ball return device has a respective right side and a left side, and further includes a supporting frame comprising a right vertical post and a left vertical post, respectively, said pair of rebound surfaces being supported between said right and left vertical posts, each one of said right and left vertical posts further includes a foot and at least one roller means attached to each said foot.

3. A ball return practice device according to claim 2, wherein said supporting frame further includes at least one roller lock means immobilizing at least one said roller means, whereby said ball return practice device is rolled to a preferred location and retained there by immobilizing said roller means.

4. A ball return device according to claim 2, wherein said supporting frame further includes means for suspending said pair of rebound surfaces in pivoting fashion thereto, and lock means for constraining said pair of rebound surfaces against pivoting.

* * * * *